United States Patent [19]

Schwab

[11] 4,234,994

[45] Nov. 25, 1980

[54] BACK AND BODY WASHER

[76] Inventor: Frederick F. Schwab, 9705 215th St., Forest Lake, Minn. 55025

[21] Appl. No.: 5,387

[22] Filed: Jan. 22, 1979

[51] Int. Cl.[3] ..... A47K 7/02

[52] U.S. Cl. ..... 15/222

[58] Field of Search ..... 15/160, 222; 128/61, 128/67, 62 R; 132/79 R

[56] References Cited

U.S. PATENT DOCUMENTS

| | | | |
|---|---|---|---|
| 1,990,568 | 2/1935 | Scheidler | 15/222 |
| 2,730,745 | 1/1956 | Norman | 132/79 R |
| 2,905,957 | 9/1959 | Volpe | 15/160 |
| 3,875,933 | 4/1975 | Schwab | 15/222 X |

FOREIGN PATENT DOCUMENTS

| | | | |
|---|---|---|---|
| 278906 | 10/1927 | United Kingdom | 15/222 |

*Primary Examiner*—Edward L. Roberts
*Attorney, Agent, or Firm*—Jacobson & Johnson

[57] ABSTRACT

A back and body washer comprising a cloth material having a long handle attached to one end and a short handle attached to the opposite end, the long handle can be grasped by the user's hand and the short handle can be grasped by the thumb or fingers of the user's other hand to allow the user to wash the user's back. When not in use, the cloth material flaps fold over each other when the cloth is supported by the long handle.

7 Claims, 16 Drawing Figures

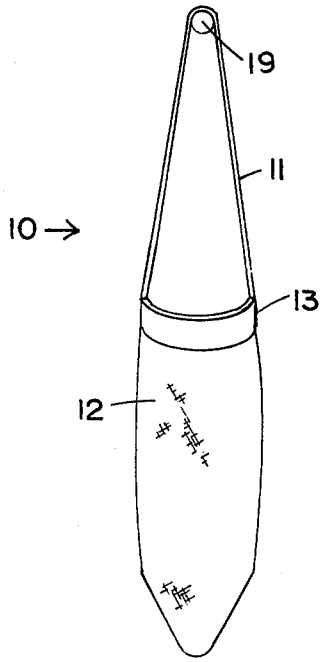
FIG. 1
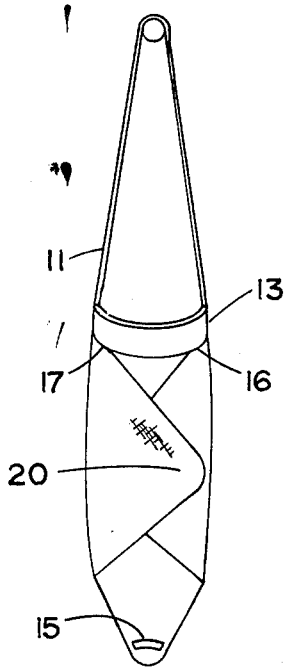
FIG. 2
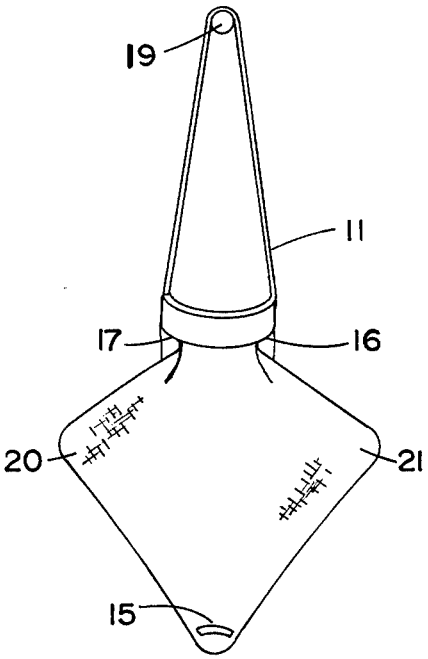
FIG. 3
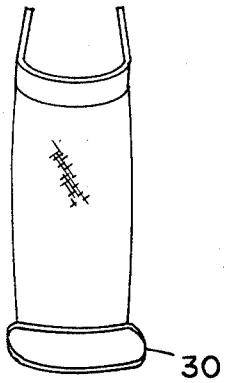
FIG. 4
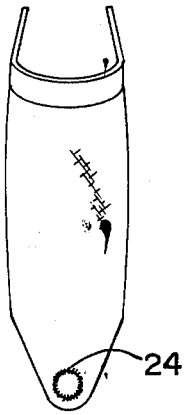
FIG. 5
FIG. 7
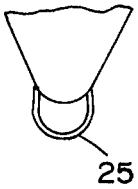
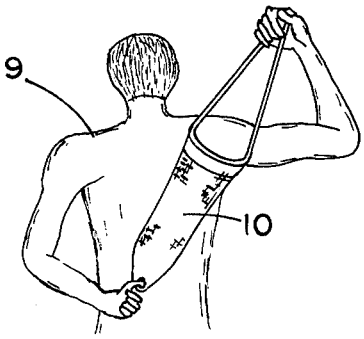
FIG. 6

BACK AND BODY WASHER

BACKGROUND OF THE INVENTION

1. Field of the Invention

This invention relates to improvements in washing articles and, more specifically, to a self-folding back and body washer that allows the user to hold one end of the cloth proximate the user's back.

2. Description of the Prior Art

The concept of back washers or massaging articles is well known in the prior art as evidenced by my U.S. Pat. No. 3,875,933. My patent shows a washing and massaging article comprising a double strip of water absorbent material having handles at both ends. The handles are formed by looping straps of resilient material and attaching them to opposite ends of a water absorbent material. Both of the ends are approximately the same width and length, the long handles allow the user to manipulate the water absorbent material across the user's back. The straps and loops are secured to the material by fastening a portion of both ends of the strap to the cloth. When tension is applied to the handles, the straps tend to hold the cloth tightly against the surface being washed.

U.S. Pat. No. 2,730,745 shows a back washer which is manipulated by holding loops located at opposite ends of a strip. U.S. Pat. No. 2,691,787 also shows an elongated strip having a short handle at the ends which are used for reciprocating the strip. In the prior art devices, the washing surface is spaced midway between the two handles. This has the disadvantage of having both the hand support points remote from the washing surface. The present invention comprises an improvement to washing articles that not only perform the washing function more effectively but also allow the washing article to be hung in a neat manner.

SUMMARY OF THE INVENTION

Briefly, the present invention comprises a back and body washer having a washing surface of a cloth material which is positioned closer to one handle than to the opposite handle. A strap handle attaches to one corner of the cloth material for engagement by user's hand and the diagonally opposite corner has means thereon for engaging with the user's thumb or fingers. The cloth material automatically folds onto itself when hung by the strap handle. The overall length of the cloth and strap is such that my back and body washer can be used to scrub the back of the user.

BRIEF DESCRIPTION OF THE DRAWING

FIG. 1 is a front view of a back and body washer in the hanging position;

FIG. 2 is a back view of the back and body washer of FIG. 1 in the hanging position;

FIG. 3 is an unfolded view of the back and body washer of FIG. 1;

FIG. 4 is a front view of an alternate embodiment of a back and body washer;

FIG. 5 is a front view of an alternate embodiment of a back and body washer;

FIG. 6 shows a user holding a back and body washer on the user's back;

FIG. 7 shows a detail view of an alternate embodiment of a lower strap on a back and body washer;

DESCRIPTION OF THE PREFERRED EMBODIMENT

Figure 10:
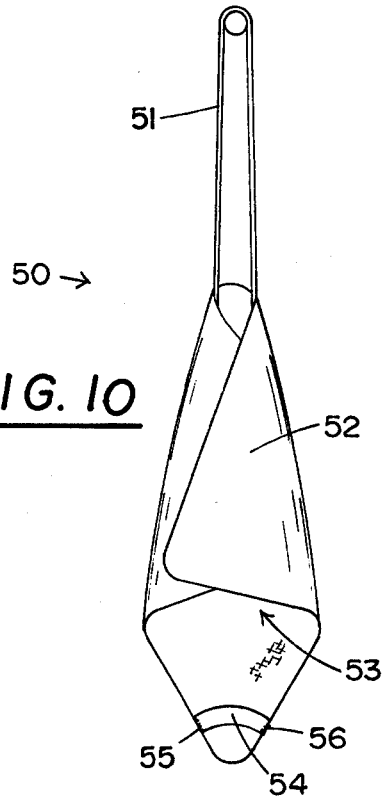
FIG. 10 is a rear view of the preferred embodiment of a back and body washer.
Figure 11:
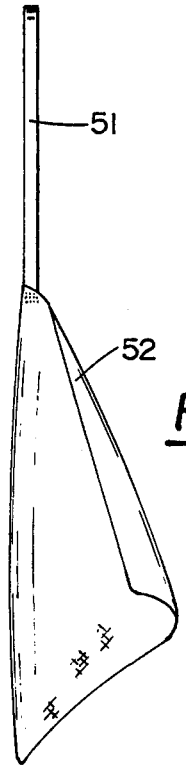
FIG. 11 is a side view of the back and body washer of FIG. 10.
Figure 12:
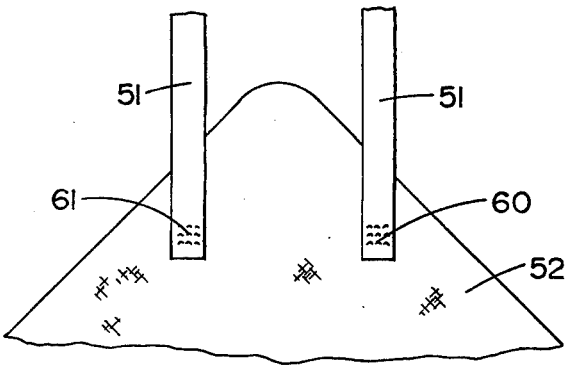
FIG. 12 is an enlarged view of the fastening strap attachment to the back and body washer of FIG. 10.

Referring to FIGS. 10, 11, and 12, reference numeral 50 generally designates the preferred embodiment of my self-folding back and body washer hanging from a peg. Back and body washer 50 includes a first strap handle 51 securely fastened to wash cloth 52. Wash cloth 50 comprises a resilient, absorbent material such as terry cloth or the like. Preferrably, wash cloth 12 has a square shape. A shorter strap 54 fastens on one edge of wash cloth 52 through stitching 55 and on an adjacent edge through stitching 56. By fastening straps on diagonally opposite corners provides a greater useable length to the wash cloth. In addition, fastening on diagonally opposite ends results in fastening on the bias of the cloth to provide natural resiliency to my back and body washer. That is, most wash cloths are cut with the square shape at a 45° angle to the bias of the cloth material.

Strap 51 is shown substantially longer than strap 55. This feature contrasts the present invention with prior art back washers that use long handles with the washing surface positioned midway between the handles.

The ends of straps 51 are fastened to cloth 52 through fastening means such as stitching or the like. While other fastening methods could be used, stitching is preferred because the stitching retains the softness of the material. The purpose of having the ends of strap 51 spaced apart from each other when fastened to cloth 52 is to provide a self-folding action when cloth 52 is suspended by the handle 51. That is, the cloth 52 tends to fold on itself and form an open cone shaped configuration 52 as shown in FIG. 10 and FIG. 11. This cone shaped appearance provides a neat appearing means of hanging the cloth in a folded position.

The lower handle 54 is shown as shorter and fastened proximate the corner diagonally opposite from strap 51; however, while strap 54 offers no assistance to the self-folding feature of the present invention, it has been discovered that fastening lower strap 54 to the adjacent edges of cloth 52 provides an excellent means for the user to grasp the shorter handle when the cloth is behind the user's back. That is, the user grasps the edge of the cloth between his fingers and thumb and slides his hand downward along the edge of the cloth until his fingers or thumb engage strap 54. Because strap 54 extends across the cloth, the user is assured that he will engage the shorter strap by merely sliding his hand along the edge of cloth 52.

Figure 13:
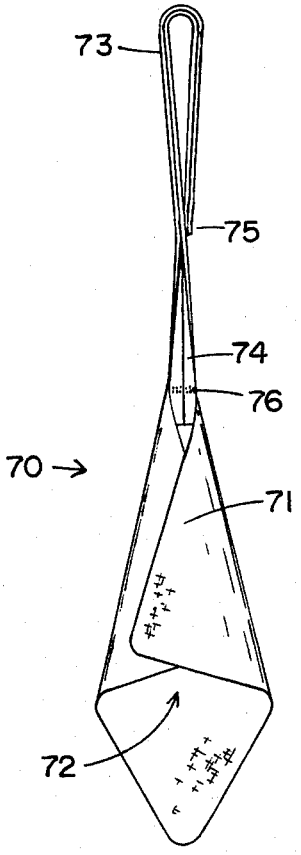
FIG. 13 is a rear view of an alternate embodiment of my invention.
Figure 14:
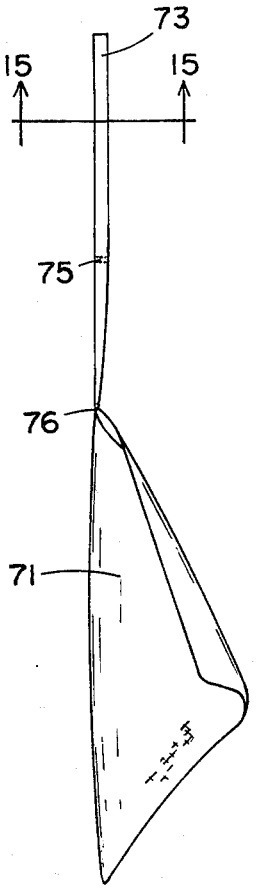
FIG. 14 is a side view of FIG. 13.
Figure 15:
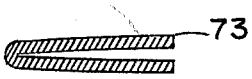
FIG. 15 is a sectional view taken along lines 15 of FIG. 14.

Referring to FIGS. 13, 14, and 15, reference numerals 70 generally designate an alternate embodiment of my self-folding back and body washer. Back and body washer 70 generally includes a strap handle 73 which is securely fastened to wash cloth 71 through stitches 76. Strap 73 comprises a folded strap material 76 which is more clearly shown in FIG. 15. One end of strap material 73 is fastened onto itself by stitching 75. The other end of strap 73 is fastened in an unfolded condition 74 to cloth 71 through stitching 76. In the embodiment of FIG. 13, note cloth 70 hangs downward in a cone shape. FIG. 15 reveals the cross section of the strap as taken along lines 15 of FIG. 4.

Figure 16:
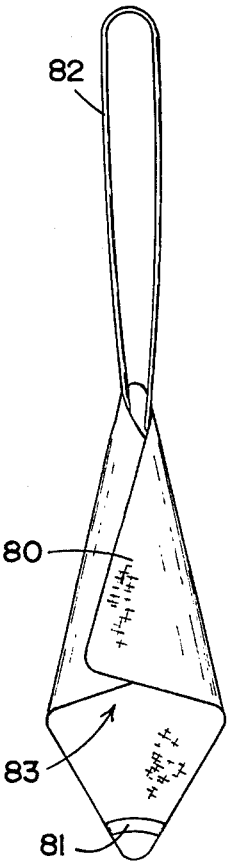
FIG. 16 is a rear view of a back and body washer having a rope cord.

Referring to FIG. 16, there is shown a rear view of a preferred embodiment of the invention having a handle 82 fastened to the top and strap handle 81 fastened to the lower diagonal corner of cloth 80. Instead of using a flat strap for handle 82, handle 82 is formed from a cord. Lower handle 81 fastens from edge to edge of the cloth to enable the user to easily grasp strap handle 81.

The ends of cord 82 may be placed adjacent one another or slightly spaced apart as shown in FIG. 16; however, in either event, wash cloth 80 hangs downward with a cone shape 83.

Referring to FIGS. 1 through 3, reference numeral 10 generally designates an alternate embodiment of my self-folding back and body washer hanging from a faucet or handle 19. Back and body washer 10 includes a first strap handle 11 securely fastened to wash cloth 12. Wash cloth 12 comprises a resilient, absorbent material such as terry cloth or the like. Preferrably, wash cloth 12 has a square shape with one of the corners cut diagonally. A band 13 attaches to the diagonally cut corner and strap 11. Note, strap 11 fastens on one corner of wash cloth 12 and a second strap 15 fastens on the diagonally opposite corner of wash cloth 12.

A further feature of the present invention is band 13 which forms the attachment of wash cloth 12 to strap 11. Cloth 12 fastens to band 13 and strap 11. Referring to FIG. 3, band 13 is shown fastened to a corner of cloth 12. The region denoted by reference numerals 16 and 17 comprise the area in which cloth 12 is folded and permanently fastened to band 13. The permanent fastening of cloth 12 in the folded position produces a natural tendency of flaps 20 and 21 to fold over each other when my back and body washer is hung by strap 11. On the other hand, FIG. 3 shows cloth 12 can be opened to almost full size in spite of the folding and fastening to band 13. This feature allows cloth 12 to be held in one hand and used to wash the user's body. In addition, the use of a single long strap greatly facilitates the use of cloth 12. That is, the one long strap can be tucked into the cloth or allowed to hang down when cloth 12 is used as a body washer. In either case the single strap does not hinder the user from using wash cloth 12 on the user's body. In contrast, conventional back washers with two long straps are cumbersome and awkward to use on the user's body.

Referring to FIG. 4 and FIG. 5, further alternate embodiments of my shorter strap are shown comprising a loop 30 and an opening 24 having a decorative pattern therearound. In either embodiment the user can insert a finger or thumb through strap 30 or opening 24. While opening 24 is shown as a cutout, opening 24 could also be a slit similar to a large button hole that would allow the user to insert his or her thumb or finger therethrough.

In a further alternate embodiment, strap 15 could be left off. In this embodiment, the user grasps the corner of cloth 12 between the fingers and thumb rather than through a loop. FIG. 7, a further alternate embodiment having a strap 25 attached to corner 25.

Figure 9:
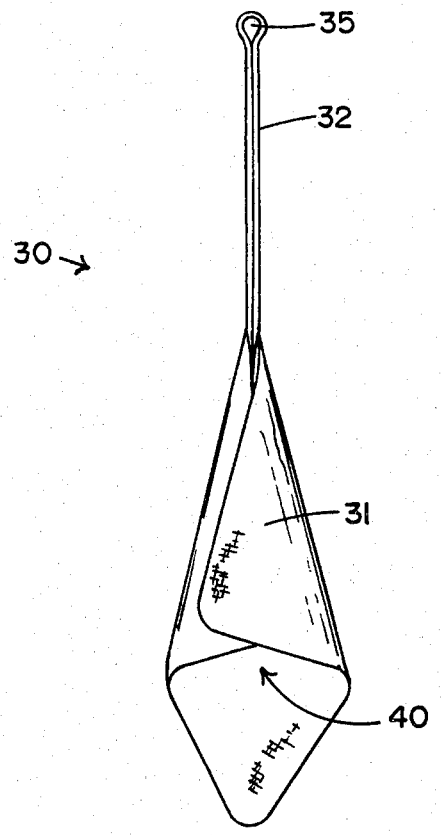
FIG. 9 is a rear view of the back and body washer of FIG. 8.
Figure 8:
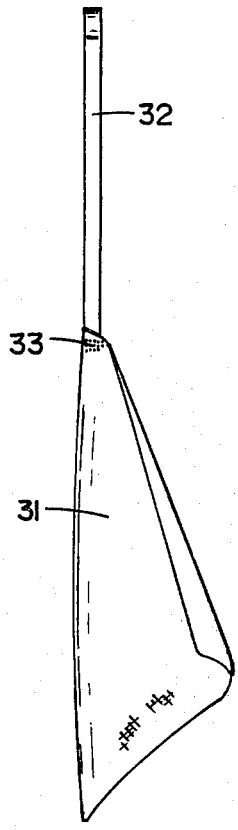
FIG. 8 is a side view of an alternate embodiment of a back and body washer.

Referring to FIGS. 8 and 9, reference numeral 30 designates an alternate embodiment of the present invention. A strap 32 attaches to one corner of wash cloth 31 by stitches 33. Located at the top of strap 32 is a loop 35 for grasping in the user's hand. A feature of the back and body washer of FIG. 8 and FIG. 9 is that when hung from strap 32 it also permits the cloth to hang in a cone with the open end of the cone 40 pointing downward. It has been discovered that by fastening strap 32 to the folded corner 33 of cloth 31, by sewing or the like, causes cloth 31 to hang in a form of a cone similar to the preferred embodiment shown in FIG. 10 and FIG. 11. Cloth 31 hanging in the cone shape not only provides a neat appearing article but also provides a self-folding back and body washer.

I claim:

1. A back and body cloth comprising:

a cloth material having a surface for rubbing over a user's back and body;

said cloth material of generally a square shape with a first portion, a second portion, a third portion and a fourth portion defining the corners of said cloth material, said cloth material having a first handle of predetermined length attached to said first portion of said cloth material, said first handle having an area for a user's hand to grasp, said second portion of said cloth material located diagonally opposite from said first portion of said cloth, said second portion of said cloth material defining a second handle so that said cloth is operable for hanging in a folded position in response to suspension of said back and body cloth from said first handle;

said second handle having an area for a user's fingers to grasp said second handle, said second handle characterized by being substantially shorter than said first handle whereby said surface for rubbing over a user's back is proximate said second handle, said second handle operable for engagement with a user's fingers or thumb so that when a user grasps said first handle and said second handle the user can rub said cloth on the user's back with an up and down motion.

2. The invention of claim 1 wherein a band extends across a portion of said cloth material, said band fastening said first handle to said cloth.

3. The invention of claim 1 wherein said second handle comprises an opening formed in said cloth.

4. The invention of claim 1 wherein said second handle comprises a corner of said cloth.

5. The invention of claim 4 wherein said first handle comprises a strap that forms a loop for a user's hand to grasp.

6. The invention of claim 5 wherein said cloth material has a bias direction and wherein said handles are fastened on the bias of the cloth material to provide resiliency to said back and body cloth.

7. A back and body cloth comprising:

a cloth material having a generally square shape with four corners and a surface for rubbing over a user's back and body;

a first handle attached to a first corner of said surface of said cloth material, said first handle having an area for a user's hand to grasp said handle, a second handle located on said surface of said cloth material and diagonally opposite from said first handle; so that said first handle and said cloth coact to support said cloth in a folded position in response to suspension of said cloth from said first handle.

* * * * *